US005212974A

United States Patent [19]

Shen

[11] Patent Number: 5,212,974

[45] Date of Patent: May 25, 1993

[54] CARD TYPE LOCKING APPARATUS

[76] Inventor: Kou-Chi Shen, Fl. 11th-1, No. 258, Sin-Yi Road, Sec. 4, Taipei, Taiwan

[21] Appl. No.: 889,247

[22] Filed: May 28, 1992

[51] Int. Cl.[5] ..... E05B 23/00

[52] U.S. Cl. ..... 70/352; 70/387; 70/392; 70/405; 70/DIG. 25

[58] Field of Search ..... 70/352, 361, 350, 355, 70/376, 377, 387, 392, 405, DIG. 25

[56] References Cited

U.S. PATENT DOCUMENTS

| | | | |
|---|---|---|---|
| 3,552,159 | 1/1971 | Craig | 70/361 X |
| 3,943,737 | 3/1976 | Lerro | 70/361 X |
| 4,126,025 | 11/1978 | Miyamae | 70/361 X |
| 4,338,805 | 7/1982 | Nygren | 70/352 X |
| 4,754,630 | 7/1988 | Kawakami | 70/352 |

FOREIGN PATENT DOCUMENTS

| | | | |
|---|---|---|---|
| 738118 | 12/1932 | France | 70/352 |

*Primary Examiner*—Lloyd A. Gall

*Attorney, Agent, or Firm*—Varndell Legal Group

[57] ABSTRACT

A card type locking apparatus having a chamber enclosed by an upper half and a lower half and having a slidable element, a spring, and four spring plungers in the chamber. When a card plate with raised blocks acting as security codes thereon is inserted into a preset opening provided on the locking apparatus, the raised blocks lift the spring plungers and urge the pin rods mounted on the spring plungers to align horizontally. When the card plate is pressed further the four pin rods enter a window formed on the upper half, which results in the backward movement of the slidable element and the release of the hook, producing the unlocked state.

3 Claims, 6 Drawing Sheets

CARD TYPE LOCKING APPARATUS

FIELD OF THE INVENTION

This invention relates to a kind of card type locking apparatus, especially to a card type locking apparatus that is generally used on leather bags, diaries, stationary cases, or something which needs to be guarded and easily opened.

BACKGROUND OF THE INVENTION

The locks generally used on leather bags, books, and cases are of traditional type using the keys of zigzagged tooth form. Such a locking mechanism is simple and crude and does not have a good locking effect. Furthermore, the keys used to unlock traditional locking apparatus do not have featured configurations and therefore cannot attract people's attention. They are easily lost. This is the problem to be solved.

OBJECT OF THE INVENTION

Therefore, it is a principal object of this invention to provide a card type locking apparatus of which the locking mechanism is designed to have some pin rods acting as security codes and therefore can fully exert its guard function.

Another object of this invention is to provide a card type locking apparatus of which the key is in card shape so that it can have more convenience for either carrying or using.

Still another object of this invention is provide a card type locking apparatus of which the key is made into a card plate in accordance with the locking mechanism and therefore it can give people a feeling of novelty, reminding them wherever they see it.

SUMMARY OF THE INVENTION

To attain the objects stated above, the invention employs a construction in which a slidable member is placed in a chamber enclosed by an upper half and a lower half, and a hook portion and four rectangular caves are provided on the slidable member, in which the hook portion catches a predetermined latching element and the four caves are provided with spring plungers on which a pin rod is provided at varying height. When the slidable member is in the chamber, the pin rods press against the wall of the upper half. At this time, the slidable member is immobile and the latching element can not be released from the hook portion in order to release its holding function. When the card key with a few raised blocks on it is inserted into the present opening, the raised blocks move the spring plungers, causing the pin rods to align in a straight line. When the card key is further pressed, the slidable member moves backwards because the pin rods have entered the window on the wall. At this moment, the latching element slips the hook portion and a spring board formed on the slidable member moves the latching element outward. Consequently, the locking apparatus is turned into the unlocked state.

With reference to the accompanying drawings, the construction and the features of this invention will be described below in detail by way of a practical example of a card type locking device as an embodiment according to this invention.

DETAILED DESCRIPTION

Figure 1:
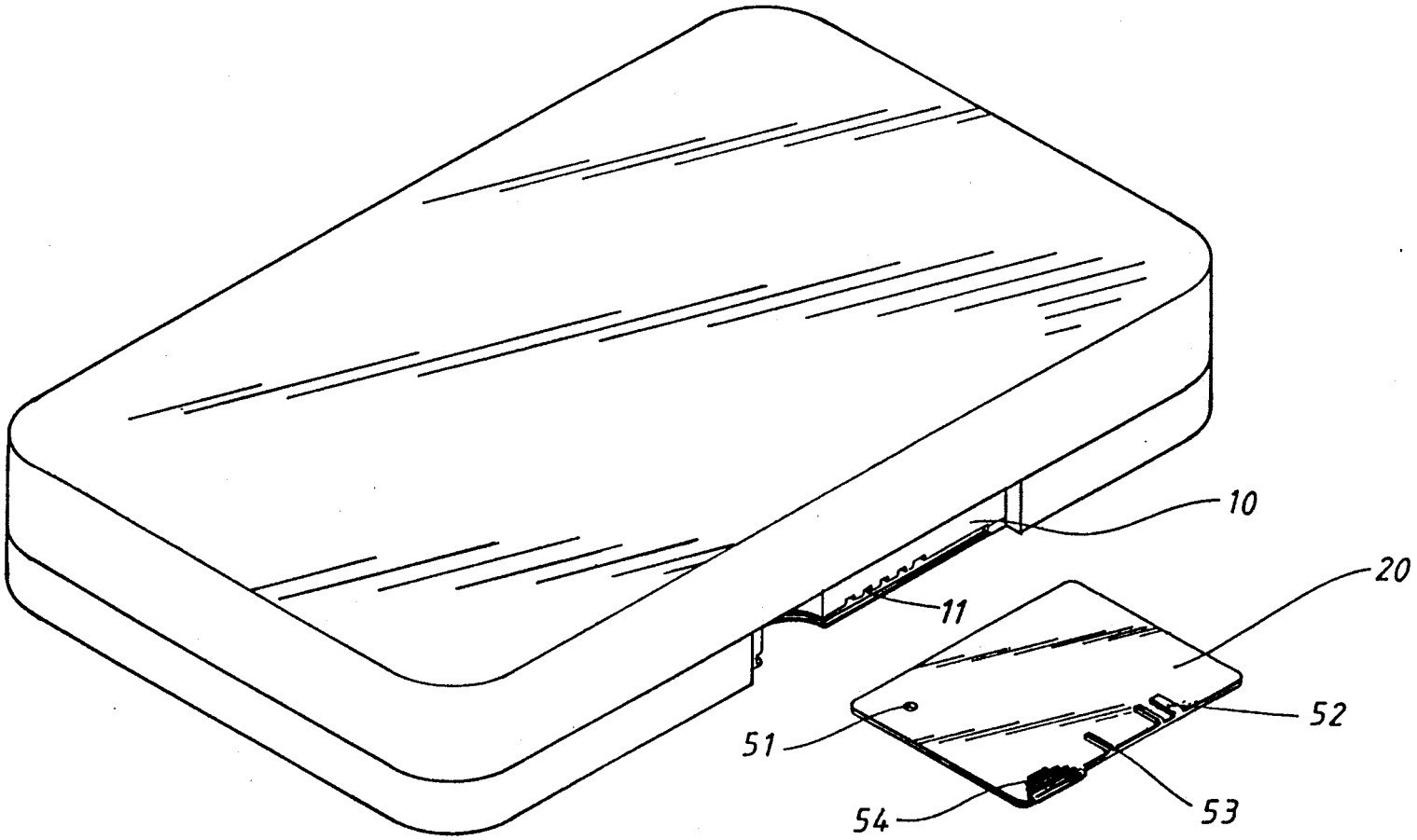
FIG. 1 is a schematic drawing showing an embodiment of a practical example of the card type locking apparatus of this invention used in a stationary case.
Figure 2:
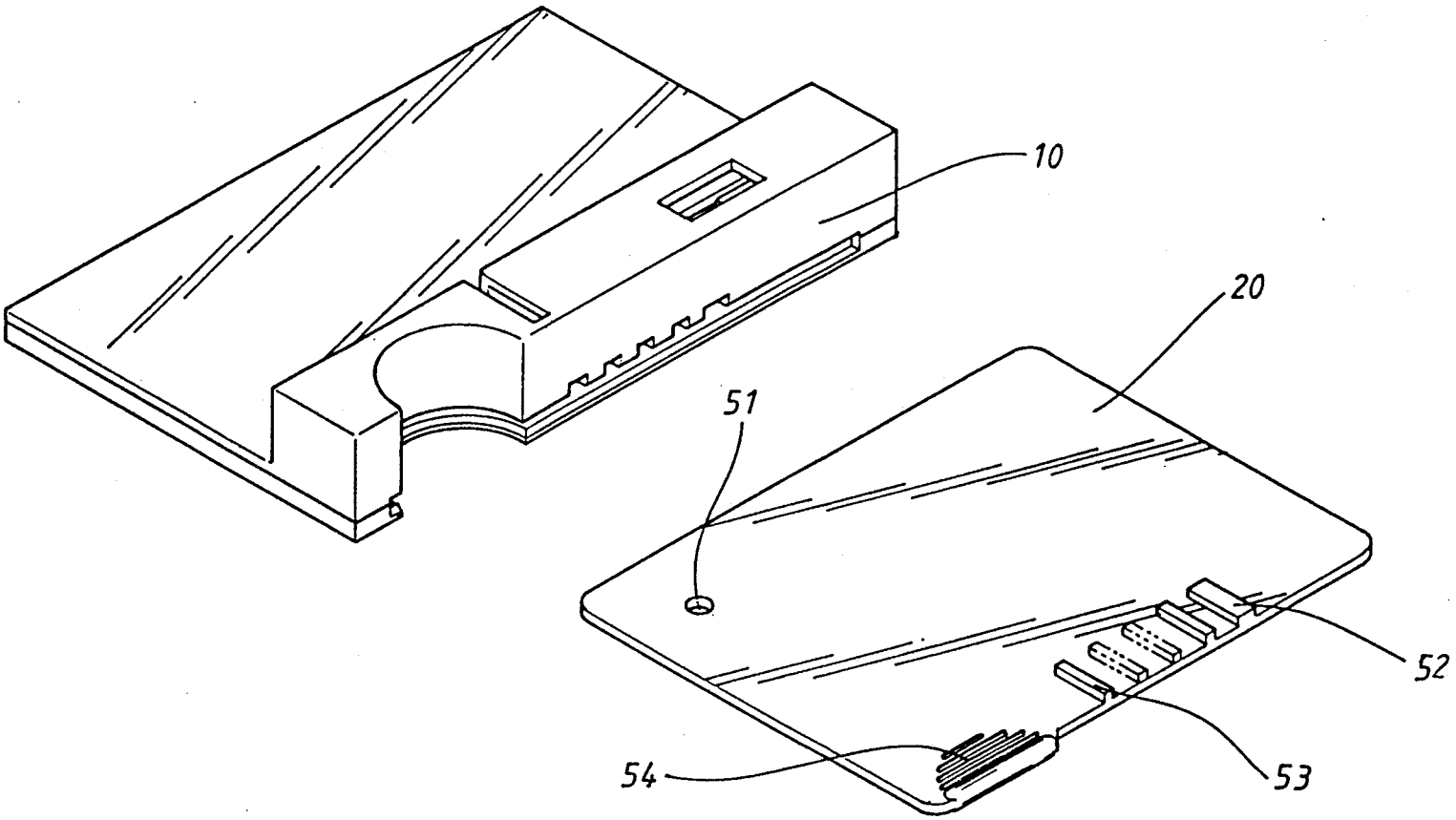
FIG. 2 is a perspective view of the lock body and the key of the locking apparatus of FIG. 1.

FIGS. 1 and 2 show an embodiment of a card type locking apparatus suitable for holding things according to the present invention. The apparatus comprises a lock body 10 and an unlocking key 20 which is designed to have a configuration of card plate with a through hole 51, a guide block 52, four raised blocks 53 in various heights on the plate, and a textured area near plate rims to facilitate hand extraction. The lock body 10 has an opening 11 for receiving unlocking key 20.

Figure 3:
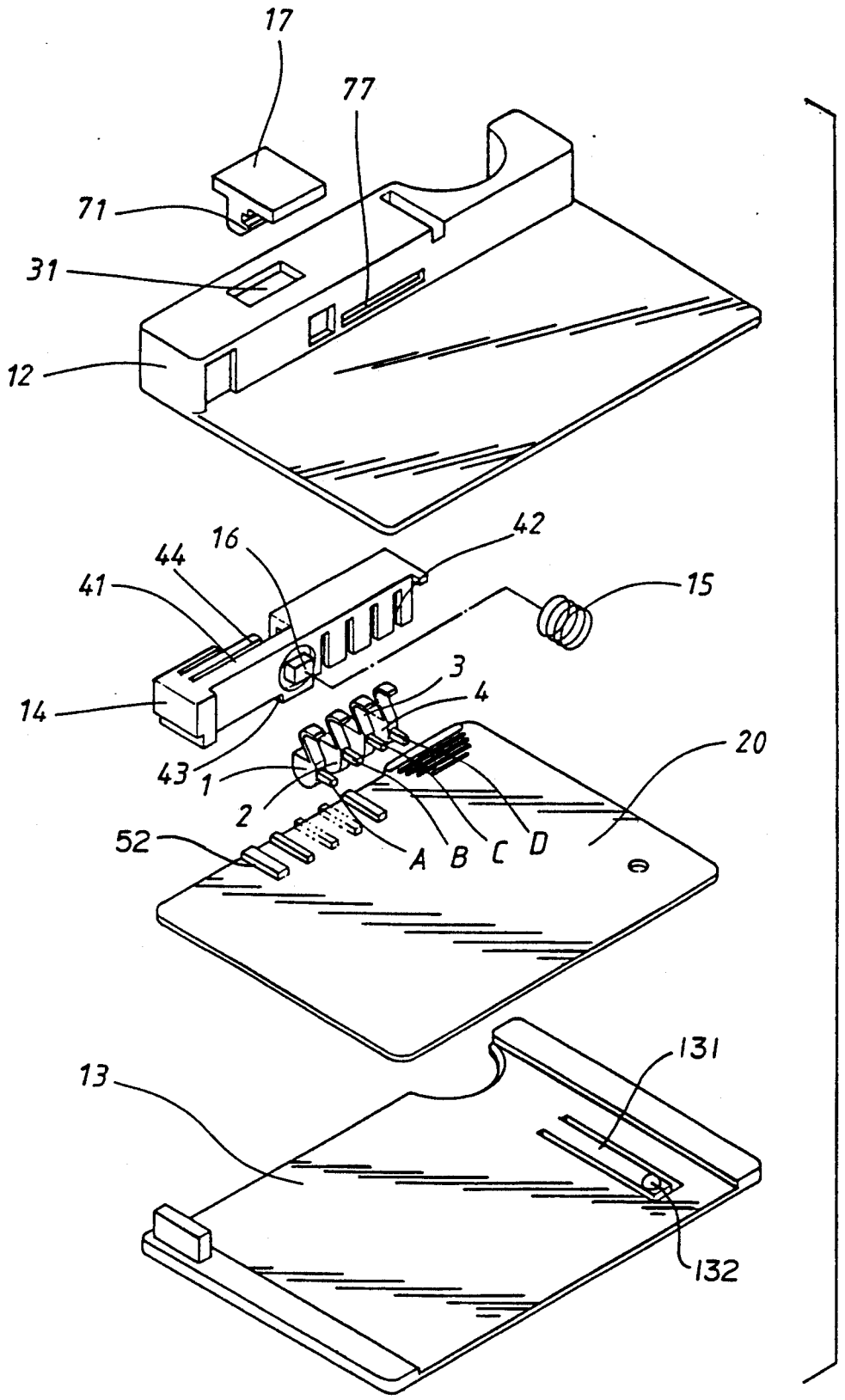
FIG. 3 is an exploded view illustrating the construction of the card type locking apparatus of FIG. 1.

As indicated in FIG. 3, the lock body of this invention chiefly comprises the upper half 12 which is a combination of a hollow box and a plate; the lower half 13; a slidable member 14; a spring 15 mounted on a projected pole 16 formed on the middle section of the slidable member 14; spring plungers 1, 2, 3, 4 on which are provided the pin rods A, B, C, D respectively; and a latching element 17. The four spring plungers 1, 2, 3, 4 are set in four rectangular caves 42 formed on the slidable member 14 and then placed in the hollow box together with the slidable member 14. The lock body is finally completed with soldering the lower half 13 to the bottom of the upper half 12. With this arrangement, the latching element 17 can be inserted through an insertion port 31 provided on the upper half 12 where the hook 71 of the latching element 17 is to be caught by the hook portion 41 of the slidable member 14.

Figure 4:
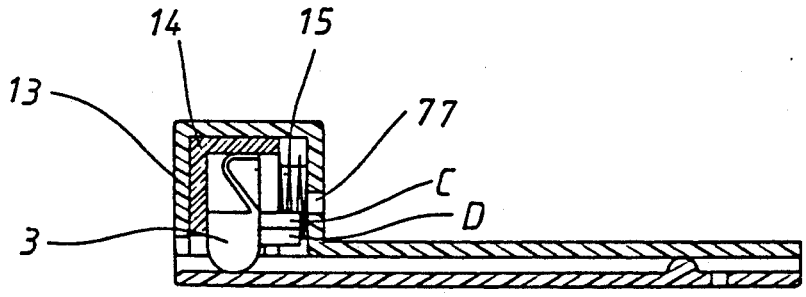
FIG. 4 is a sectional view of the lock body of FIG. 2, indicating the positions of the spring plungers in the lock body relative to other elements.
Figure 5:
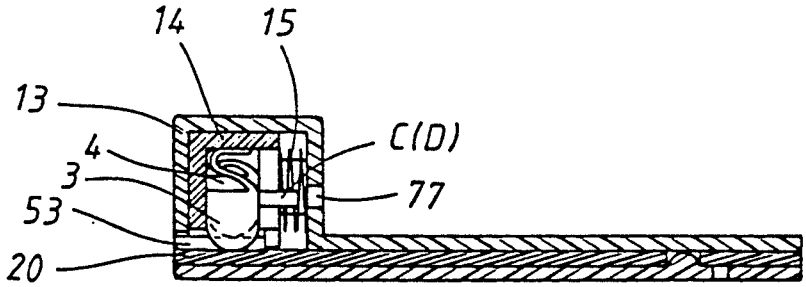
FIG. 5 is a sectional view similar to FIG. 4, but in a state where the key is inserted.
Figure 6:
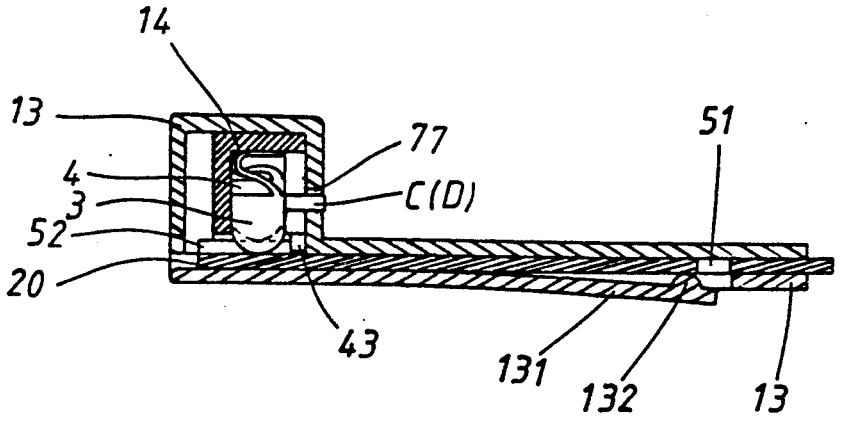
FIG. 6 is also a sectional view of the lock body shown in FIG. 4, but in another state subsequent to the one of FIG. 5, illustrating the backward movement of the slidable member as the inserted key is pressed down.
Figure 7:
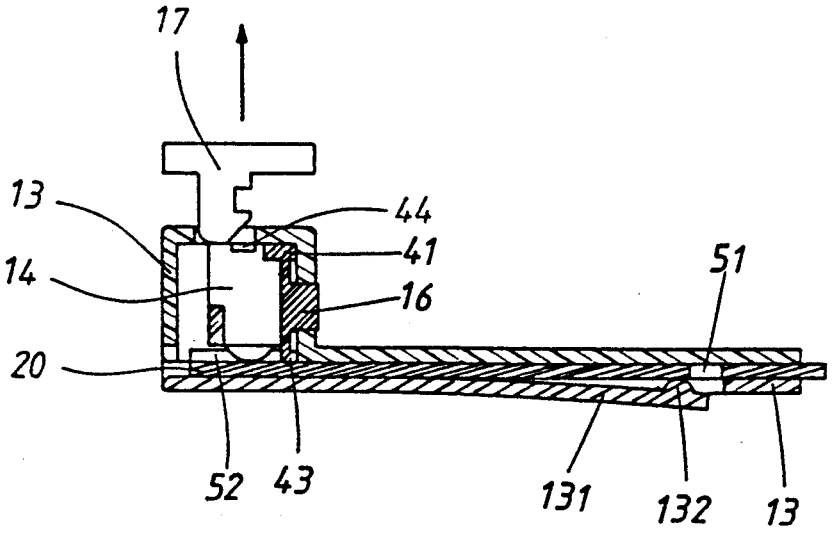
FIGS. 7 through 9 are sectional views of the embodiment of the locking apparatus according to this invention, FIG. 7 showing the release of the hook element due to the backward movement of the slidable member, FIG. 8 similar to FIG. 7 but in a state where the hook element is on the verge of being locked, and FIG. 9 similar to FIG. 7 but in another state where the hook element has been caught.

Referring to FIG. 4, the lock apparatus is originally in a locked state where the spring 15 pushes against the slidable member 14 and the pin rods A, B, C, D on the spring plungers press against the periphery of a window 77 at varying heights. The window faces the slidable member 14. As can be seen in FIG. 5, when the key is inserted, the raised blocks 53 on the key lift the spring plungers from bottoms and make four pin rods A, B, C, D align to a horizontal level. At this moment, pressing the key 20 further in the direction of insertion (rightward as shown in FIG. 6), causes the guide block 52 on the key 20 to push against a raised portion 43 formed on the slidable member 14. This results in the movement of the slidable member 14 rightward together with the pin rods A, B, C, and D which enter the window 77. As a consequence, a spring board 44 moves the latching element 17 outwards (upwards as shown in FIG. 7), resulting in the apparatus being placed in the unlocked state. As explained above, in order to release latching element 17 from the hook 41, the user must push the card further to the right as shown in FIG. 7. During this operation, the hole 51 of the key will be released from the protruding ball 132 and the elastic bar 131 will move downward. This enables one end of the guide block 52 to push against raised portion 43 and move it rightward to release latching element 17 as shown in FIG. 7.

Figure 8:
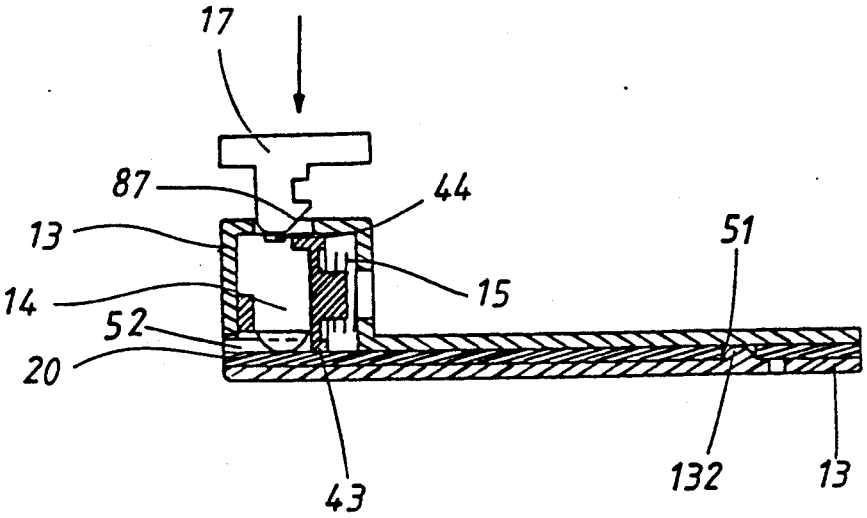
Figure 9:
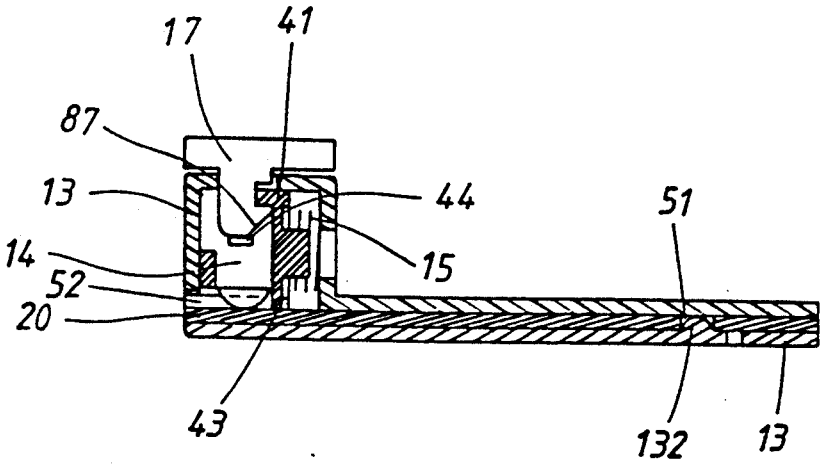

With reference to FIGS. 8 and 9, when the locking apparatus is unlocked, the spring 15 urges the slidable member 14 to return to the initial (locked) state. When locking is desired again, the latching element 17 is pressed into the insertion port 31, while the key is inserted so as to align pins A–D permitting them to pass through window 77. A slanted surface 87 on the latching element 17 urges the slidable member 14 to move away and then bounce back, resulting in the hook portion 41 holding the latching element 17 as shown in FIG. 9.

As described above, the locking apparatus of this invention employs a locking mechanism wherein a slidable member is set in a lock body, on which slidable member a few pin rods are provided to hold the unlocking movement. As a key with a few raised blocks acting as security codes on it is inserted, the pin rods are all lifted to the same level permitting the locking mechanism to become unlocked. The configuration and whole construction of the present invention are novel and innovative and provides an excellent locking function. Thus, this invention is a new and practical one.

What is claimed is:

1. A locking apparatus which comprises a key and a lock body, said key having a shape of a flat card including a guide block and a plurality of raised blocks on an upper flat surface thereof, and said lock body having an upper half soldered to a lower half with an opening therebetween for receiving said key, said upper half including a hollow portion having a side wall with a window formed therein, said hollow portion encasing a slidable member facing said window, a spring element arranged between said side wall and said slidable member and biasing said slidable member away from said side wall, said slidable member having a raised portion, a spring board biasing a latching element toward an opened position, a hook engaging said latching element when said locking apparatus is in a locked condition, and caves receiving spring plungers, said spring plungers having pin rods misaligned with said window when said locking apparatus is in said locked condition, wherein when said key is initially inserted into said opening, said raised blocks move said spring plungers and align said pin rods with said window and said guide block of said key abuts said raised portion of said slidable member; and when said key is further inserted into said opening, said pin rods pass through said window, said guide block pushes said slidable member causing said hook to disengage from said latching element, thereby opening said locking apparatus.

2. The locking apparatus as claimed in claim 1, wherein said upper half has an opening for receiving said latching element.

3. The locking apparatus as claimed in claim 1, wherein said pin rods have different heights.

* * * * *